US005499593A

United States Patent [19]

Raab

[11] Patent Number: 5,499,593

[45] Date of Patent: Mar. 19, 1996

[54] BOAT HULL

[76] Inventor: Manfred Raab, 39, Syngrou Avenue, Athens, Greece, 11743

[21] Appl. No.: 859,354

[22] PCT Filed: Nov. 27, 1990

[86] PCT No.: PCT/EP90/02028

§ 371 Date: May 22, 1992

§ 102(e) Date: May 22, 1992

[87] PCT Pub. No.: WO91/08137

PCT Pub. Date: Jun. 13, 1991

[30] Foreign Application Priority Data

Nov. 27, 1989 [AT] Austria ..... 2713/89

[51] Int. Cl.[6] ..... B63B 1/04

[52] U.S. Cl. ..... 114/271; 114/56

[58] Field of Search ..... 114/56, 62, 271

[56] References Cited

U.S. PATENT DOCUMENTS

| | | | |
|---|---|---|---|
| 912,814 | 2/1909 | Clifford | 114/62 |
| 1,505,113 | 8/1924 | Warnock . | |
| 3,342,032 | 9/1967 | Cox et al. | 114/62 |
| 4,742,739 | 5/1988 | Mader | 114/56 |
| 5,199,366 | 4/1993 | Ranchi | 114/56 |

FOREIGN PATENT DOCUMENTS

| | | | |
|---|---|---|---|
| 507556 | 9/1920 | France . | |
| 515361 | 3/1921 | France . | |
| 689792 | 9/1930 | France . | |
| 687340 | 1/1940 | Germany . | |
| 872018 | 2/1953 | Germany | 114/56 |
| 3022966 | 12/1981 | Germany . | |
| 1025454 | 4/1966 | United Kingdom . | |
| WO89/04273 | 5/1989 | WIPO . | |

OTHER PUBLICATIONS

Lindsay Lord, *Naval Architecture of Planing Hulls,* Cornell Maritime Press, New York, 1946, pp. 169–172.

*Primary Examiner*—Michael S. Huppert
*Assistant Examiner*—Thomas J. Brahan
*Attorney, Agent, or Firm*—Townsend and Townsend and Crew

[57] ABSTRACT

The invention relates to a boat hull, in particular for high speed crafts, the underside of which has in at least one longitudinal section through or, respectively, parallel to the center plane a profile similar to the profile of an aircraft wing, the vertex of the longitudinal sectional profile, with respect to the bow-side end point of the chord of the longitudinal sectional profile, being positioned in the front half of the entire length of the chord. According to the invention there is provided that the chord (1) of the unloaded boat hull (2) includes an angle () with the horizontal plane defined by the water level (3) of 1° to 3°, preferably of 1.5° to 2.5°, in particular of 1.8° to 2.2°, so that the stern-side end point (4) of the profile is positioned at the lower end point of the stern or, respectively, of the transom (5) below the water level (3).

16 Claims, 2 Drawing Sheets

10
1
4'
70
5
4
38
5'
3
4
$\varphi_H$
8
9"
54
1
4"
51
$y_{max}$
38
8
9
74
2
62
4'
$\varphi$
$y_{max}$
52
60
66
10
X 4'''
70
4
3
38
4
1
8'
8
7
6
8
9
51
2
4'
54
$\varphi$
$\varphi_V$
74
9
4

44
42
40
y
38
46
46

38
48
48
42
y

A
B
C
D
38
42
48
50

BOAT HULL

BACKGROUND OF THE INVENTION

The invention relates to a boat hull for high-speed planing hulls, the underside of which has a profile in a longitudinal section through or, respectively, parallel to the center plane similar to the profile of an aircraft wing having curvatures, the vertex point of the longitudinal sectional profile, with reference to the bow-side endpoint of the chord of the longitudinal sectional profile, being positioned in the front half of the entire length of the chord, and wherein the stern-side endpoint of the profile is positioned at the lower endpoint of the stern or, respectively, transom below the water level.

Boat hulls of similar kind are known, for example from the DE-PS 30 22 966 or, respectively, from the FR-PS 515 361; this known boat hull, however, has several disadvantages. By the relatively strong curvature of the profile of the boat hull according to the DE-PS in the front region of the profile, the flow around the boat hull is accelerated at this place, whereby a zone of low pressure is created and the boat hull in this region is "sucked on" by the water. This is called "inverse wing effect", which occurs also in connection with the underside of an aircraft wing. By reduction of the profile curvature in the rear region of the profile, the flow speed is reduced in this region with respect to the front region of the profile, whereby a zone of high-pressure is created which presses the rear end of the profile upwardly, therefore out of the water. By these two forces, namely the downwardly directed suction force in the front part of the profile and the upwardly directed pressure force in the rear part, a trim moment by the bow is created, that is a moment around a point at a place between the points of application of the lifting force and the depression force, which moment may press the bow of the boat to down, therefore downwards, so that the boat is trimmed by the bow. This trim effect generally is a function of the shape of the profile as well as of the speed of advance flow and of the inclination angle of the profile or, respectively, of the profile chord. In case of a boat hull according to the DE-PS 30 22 966, the inclination angle of the profile for the stillstanding, unloaded boat is almost 0, so that the hitherto described effect can be understood substantially as a function of the shape of the profile and the speed of advance. The just described effect that has its reasons in the shape of the profile of the boat hull, finally is superimposed by the effect of a flow against an inclined flat plate, wherein the term "flow against an inclined flat plate" must be understood as a terminus technicus.

If a watercraft vessel increases its speed, also its bow-wave is increased. If the speed of the watercraft vessel is greater than the wave propagation speed of the bow-wave of the watercraft vessel, the boat hull incides, that means it trims by the stern; in simplified words, the ship tries to ride on its own bow-wave. As already said, the boat hull thereby trims by the stern, the inclination angle of the profile is changed and thereby also the depression force of the profile changes. Substantial parts of the boat hull are no more hit by the inclined against flow as a "profile", but as a "flat plate", whereby in the forebody a buoyancy component is created which acts against the bow-heavy trim moment. Supposing that the boat can bring sufficient power, the boat reaches a planing condition, which, however, when compared with conventional planing hulls, due to the curvature of the profile in the forebody is characterized by an increased resistance caused by an increased wetted surface as well as an increased wave resistance.

Further, within this known boat hull the suction component created by the arch of the profile in the front region of the profile, due to the horizontal in-flow, is so strong that a transition into the planing condition is indeed possible, however at the same time significantly more energy is absorbed as if, for example by a reduction of the arch of the profile and simultaneous inclination of the profile, the depression force tendencies in the region of the forebody are reduced to an extent necessary to avoid an excessive sloping or, respectively, inclination of the ship body or, respectively, boat hull at the moment at which the ship or boat begins to ride on its own bow-wave, as this is the case within the known body.

Similar problems arise within the boat hull according to the FR-PS 515 361 which has a substantial bent in the course of the longitudinal sectional profile which detrimentally influences the flow along the boat hull, which boat hull is designed as a chine hull. Further, the angle included by the chord with the water surface, is too small in order to enable optimal start of planing and energy-saving planing.

Finally, from "Naval Architecture of Planing Hulls" by Lindsay Lord, 1946, the possibility has become known to calculate the resistance of a planing boat or, respectively, of an even planing plate, wherein particularly it was referred to the planing angle. In this publication a planing angle of 2° has been designated as being optimal, for an angle of more than 2° the wave drag could increase and for an angle of less than 2° the wetted surface could increase. This, however, holds generally for all kinds of planing boats having even planing areas, however not for planing areas having the profile of an aircraft wing.

It is a basic problem of all planing vessels to lift the stern out of the water, when being under way; this is possible either by shape-conditioned, dynamic buoyancy or, however, by auxiliary lift means, such as trim flaps, side wedges etc.

The boat hull known from the DE-PS is in particular destined for sailing yawls or sailing yachts, therefore for boats without engines and shall compensate common trimming by the stern in the range of high-speed displacement mode by a trim moment by the bow and shall thereby reduce the wave resistance part which in this phase between displacement mode and planing mode naturally is very great. Simultaneously an increase of the wave resistance by a transom which is too much submerged, shall be reduced, particularly in the said speed range. Under this point of view, namely a resistance as small as possible in the border region between displacement mode and planing mode, this known shape of a boat is technically ingenious.

SUMMARY OF THE INVENTION

It is the object of the invention to increase the lift component in the stern of the hull, in particular of the hydrodynamic lift in the high-speed planing condition. In order to improve the planing properties, the power demand for the high-speed planing mode shall be reduced. In particular, the invention has at its object to provide a relatively compromise-free planing hull with which the transition period between displacement mode and planing mode shall be kept as short as possible and as less power-consuming as possible.

Within a boat hull of the initially described kind, these objects according to the invention are achieved in that the chord of the bent-free or, respectively, discontinuity-free or, respectively, fairing longitudinal-sectional profile of the loaded and/or unloaded boat hull includes with the horizontal plane defined by the water level an angle of 1.3° to 4°, preferably of 1.5° to 2.5°, in particular of 1.8° to 2.2°.

The inventive boat hull has a profile similar to the profile of an aircraft wing, consisting of a definite continuous line without bending points or points of discontinuity, so that for each point of the profile only one definite tangent to the profile curve is possible. Within this, the summit point of the longitudinal sectional profile, with reference to the bow-side end point of the chord of the longitudinal sectional profile, is positioned in the front half of the entire chord length and at unloaded or loaded boat hull the chord includes with the horizontal plane defined by the water level the angle . The aft body is free of planing areas; own or even planing areas are not provided on the boat hull; planing areas which introduce air below the boat hull are avoided therefore. The planing properties are enhanced if the forebody is U-frame-shaped or, respectively, round-frame-shaped or, respectively, if the forebody is provided with frames which are drawn inwardly and upwardly.

The angle between the chord and the water level can be adjusted either by trimming of the unloaded boat (trimming weights, chains, feetballast) or by corresponding loading of the ship. Once the desired angle has been adjusted by trimming of the unloaded ship, this angle should not be varied by the load or, respectively, within the given limits only.

According to the invention it is further provided that the bent-free aircraft profile it almost designed free of cross flow and that the cross flowing displacement flow caused by the forebody leaves the boat hull on the side free and hydrodynamically unused. This embodiment avoids that the flow caused by the forebody detrimentally influences the behaviour of the after-body, the planing properties of the after-body being optimally effective because the lift in the after-body can be produced at least mostly by the flow parallel to the longitudinal axis of the ship.

According to the invention it is further provided that the longitudinal sectional profile has a point of inflection that is positioned in a distance from the bow-side end point of the profile of at least 30%, preferably of at least 50%, in particular of at least 60% of the entire length of the chord.

Within a preferred embodiment of the invention it is provided that the longitudinal sectional profile intersects the chord at least once in the region of the stern-side half of the chord.

By the curvature of the profile in the front region of the profile the flow at this place around the inventive boat hull is accelerated, wherebai a zone of low-pressure is created, whereby the boat hull is "sucked down" in the said region. By the reduction of the curvature of the profile in the rear region of the profile or, respectively, by the tunnel in the rear section of the profile (this terminus technicus describes the underwater-shape of the body which is created by designing the vertical sections through the ship body running parallel to the longitudinal center axis of the body as aircraft wing profiles having a point of inflection) the flow velocity is reduced with respect to the front region of the profile, whereby a zone of high-pressure is created which presses the rear end of the profile to above, therefore out of the water. By these two forces a trimming moment is created that appears to be suitable to trim the boat by the bow.

However, the buoyancy forces of the "body hit by an oblique advance flow" act against this trimming moment, the ship body appearing as such a body due to the chord of at least the center longitudinal sectional profile which at zero speed in unloaded or, respectively, completely loaded condition of the watercraft vessel is obliquely disposed towards the backside, that means is inclined. These lift forces neutralize in the planing condition not only the bow trim moment but provide an additional dynamic buoyancy in the forebody so that, due to the appearing dynamic trim to the stern, the wetted surface of the watercraft vessel is reduced to a minimum; at the same time the residual drag in the planing condition is reduced due to the trim by the stern.

It must be noted that the inventive profile having a point of inflection merges in a stern-side end point positioned outside the water surface. The static trim provided according to the invention (loaded or unloaded at zero speed), that means the inclination of the profile chord of the boat hull having in its longitudinal section the shape of an aircraft wing, with respect to the water level, which trim makes the boat hull in unloaded or, respectively, loaded condition of the watercraft vessel trimmed by the stern , which angle amounts in particular to about 1.8° to 2.2°, must be considered as a very important angle in the ship building technics. Usually, the trimming condition of a high speed watercraft vessel is measured to an exactness of hundredths of a degree, and deviations of tenths of degreess are determined by the aid of complicated trimming measures and measuring means and are equalized. In practice, the inventive boat hull comprises a lower edge of the transom which due to the inclination of the chord of the unloaded and/or loaded boat, lies considerably under water, the depth of immersion corresponds to the tangent of the angle of inclination, multiplied by the length of the chord, which value amounts for a ship having a length of for example 5 m already to about 15 cm. Known boat hulls having the shape of an aircraft wing have trimming values which considerably deviate from these inventive values.

Within the inventive boat hull the lift component in the stern region is considerable because the longitudinal profile section in this region has a point of inflection and the longitudinal sectional profile may even intersect the chord and extends above the chord, whereby the tunnel effect is considerably increased and made more effective for the desired lift in the after-body. Just by inclination of the chord of the longitudinal sectional profile with respect to the water line of the floating unloaded or, respectively, loaded, still-standing watercraft, on way the dynamic lift in the stern region is considerably increased, whereby significant favourable properties are obtained with respect to the planing properties and to the power consumption.

Advantageous embodiments of the invention can be taken from the following specification, the patent claims and the drawing.

BRIEF DESCRIPTION OF THE DRAWINGS

In the following the inventive boat hull is explained nearer in detail along the example of the drawing.

DESCRIPTION OF THE PREFERRED EMBODIMENT

Figure 1:
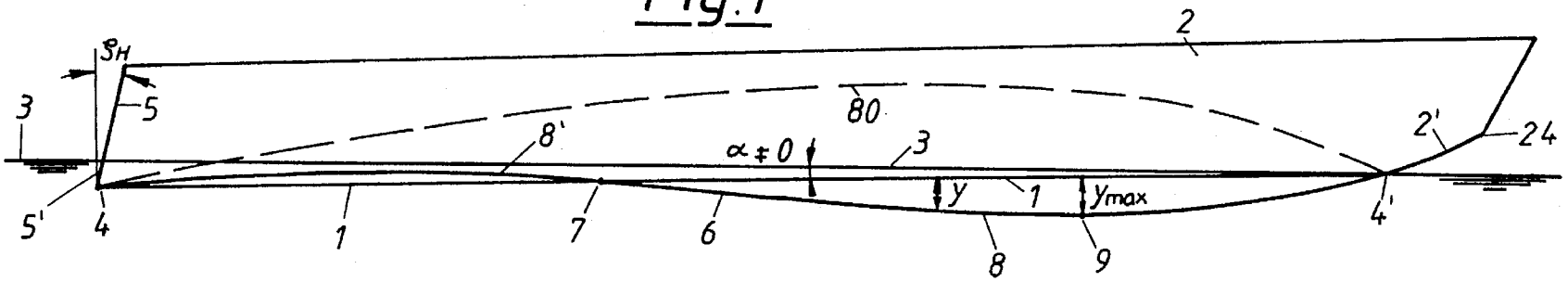
FIGS. 1, 2 and 3 show different embodiments of inventive boat hulls.

FIG. 1 shows a schematical section through an inventive boat hull 2. The boat hull 2 comprises in the shown central section an underwater profile formed by a curved profile section designated in general by 8. A section 5' of the stern 5 leads from the rear end 4 of the profile upwardly to the water level 3. The profile line 8 extends in the bow section from the front end 4' of the underwater profile 8, if desired offset, beyond the water level 3 into the bow section 2', preferably in a continuous, uninterrupted profile line; in the stern the section 5', positioned under water, extends into the stern line 5 positioned above the water level 3, preferably in form of a straight transition. The chord 1 of the profile 8 extends from the bow-side end 4', that is the front point of intersection of the profile 8 with the water level 3, to the stern-side end 4 of the profile chord I that is disposed below the water level 3 and is intersected by the stern line 5, 5' that extends perpendicularly to the water level or includes an angle $_H$ (FIG. 1, 7) therewith. The chord 1 includes with a horizontal plane constituted by the water level 3 an angle between 1° and 3°, preferably about 2° . At rest with an unloaded boat hull 2, therefore, the entire chord 1, particularly the stern section or, respectively, the end 4 of the chord 1 or, respectively, of the profile longitudinal section 8, is disposed below the water level 3, whilst the bow-side end 4' of the chord 1 is disposed as exact as possible in the water level. By the dotted line 80 the profile 8 is completed to an aircraft wing-like profile.

The profile 8 shown in FIG. 1 extends curved from the bow-side end 4' to the apex point 9 having the greatest chord distance $Y_{max}$, increases then up to a point of inflection 6 disposed narrowly below the chord 1, intersects the chord 1 in a point of intersection 7, then extends with a section 8' above the chord 1 and merges then by intersection, that is not tangentially, at the end 4 into the chord 1. Thereby the desired dynamic buoyancy values are obtained in the stern section of the boat hull 2, in particular by the curvature of the profile section 8'.

Figure 3:
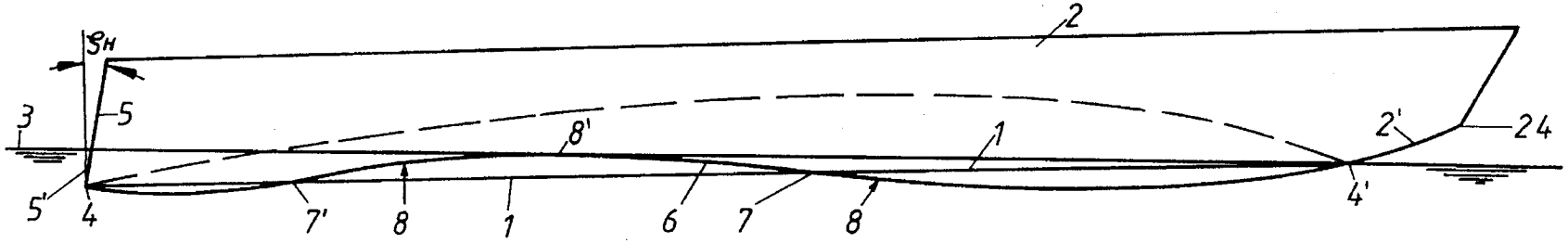

A similar profile is shown in FIG. 3, in which the profile line 8 comprises a further point of intersection 7' with the chord 1. In case of two points of intersection 7,7' the rear end section of the profile line 8' merges from below and by intersection with the chord 1 into the end point 4.

Figure 2:
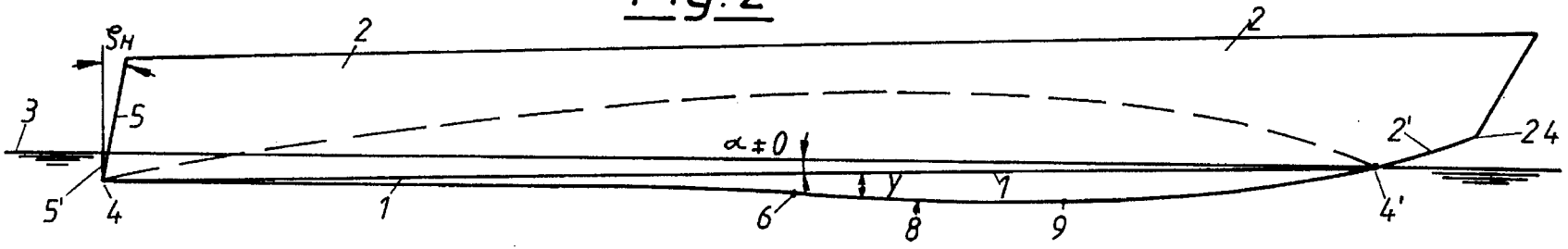

FIG. 2 shows a course of a profile in which the profile 8, starting from a front end point 4' disposed in the water level 3, at first increases in thickness towards the apex point 9, then decreases and shows a point of inflection 6, from which the profile further decreases and merges by intersection, not tangential, into the stern-side end 4 of the chord 1, to which the profile section 5' is connected.

In unloaded condition of the boat hull 2, the lower edge of the stern that, insofar as it extends horizontally, coincides in the drawing with the end point 4, is disposed with its entire length running perpendicularly to the center section below the water level.

As FIG. 2 shows, it is of advantage if the height y of the longitudinal section of the profile 8 below the chord 1 between the stern side end 4 of the chord 1 and a section of 20%–40%, preferably 20% to 30% of the entire length of the chord decreases with respect to the profile height $Y_{max}$ in the apex point 9 to less than 20%, preferably less than 15% and merges by intersection from below into the end point 4 of the chord 1 that is disposed below the horizontal plane 3. Thereby a well-balanced trimming condition at rapid planing speed is obtained. Generally it is suitable if the apex point 9 of the profile longitudinal section 8, with respect to the bow-side end 4' of the chord 1, is within a distance range of 20% to 40%, particularly 25% to 35% of the entire length of the chord. Thereby, the so-called "sucking-off" of the bow section of the boat hull is kept without limits and a well-balanced performance at the start is obtained. Within this, it is suitable if the height $y_{max}$ of the profile longitudinal section 8 in the apex point 9 amounts to less than 20%, preferably less than 15%, of the length of the chord.

Very suitable values for the tunnel are given if the height of the section 8' of the longitudinal section profile 8 running above the chord 1 amounts up to 20%, preferably up to 15% of the length of the chord.

To the front, the longitudinal section profile of the bottom side of the boat hull 2 above the horizontal plane 3 (water level) is preferably continued with constant or only little changed curvature up to a point 24. The further configuration depends from the shape of the bow for which different designs are possible.

Figure 4:
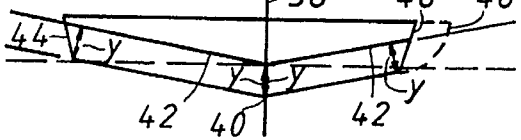
Figure 5:
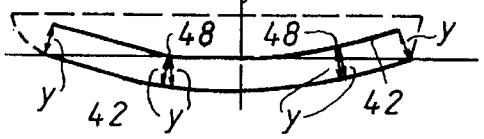

It is possible to produce boat hulls at which the profile chord plane 42 (the plane constituted by neighbouring chords 1) of adjacent profile longitudinal sections intersects the water lines 3 at a predetermined angle, what is shown in FIGS. 4 and 5. The left hand half of FIG. 4 shows a vertical cross section through a boat hull at which the inventive configuration of the profile or, respectively, of the chords of the boat hull 2 is limited to a narrow zone 40 that includes the vertical longitudinal center plane 38. Therefore, only for this zone 40, the front end 4' of the chord 1 is disposed in the horizontal plane 3; the chord 1, however, is still inclined at an angle to the horizontal plane in an advantageous manner. The longitudinal profiles of the bottom side of the boat hull extending in a greater distance from the longitudinal center plane 38 indeed have the same configuration as the longitudinal section profile in the zone 4, however, they are positioned at different heights. Their chords, namely, are disposed in the surfaces 42 rising towards the sides 44, 46 of the boat hull. Within the embodiments shown to the right and to the left in FIG. 4, the surfaces 42 are planes. The sides of the boat hull may have straight frames 44, as this is shown in FIG. 4 to left, or also curved frames 46, as this is shown in FIG. 4 to right.

In FIG. 5 two embodiments are shown in which the surfaces 42 are not planar, but buckled. Within this, the bent lines 48 constitute straight lines running parallel to the vertical longitudinal center plane 38 of the boat hull.

Figure 6:
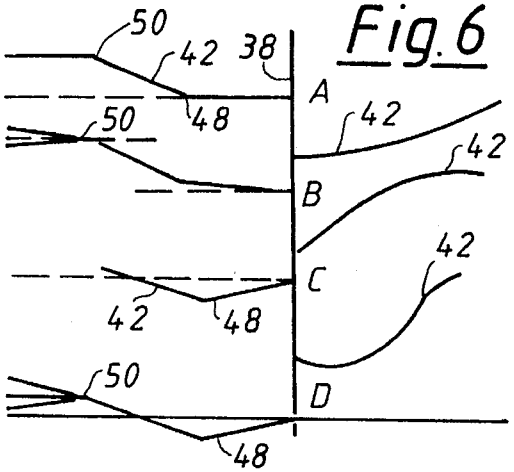

Further complicated multiple-bent surface disposals are shown in FIG. 6. The characteristic lines shown there represent the surfaces 42 in which the respective chords I of the vertical longitudinal section profiles of the bottom side of the boat hull are disposed. The line A is bent twice, namely at 48 and 50. The line B is also bent twice and extends, starting from the vertical longitudinal center plane 38, upward at first moderately and then intensively and outside the bending line 50 either upwards or downwards. The line C shows a surface 42 that, starting from the vertical longitudinal center plane 38, extends at first moderately downwards and outside the bending line 48 upwards. The line D is similar to the line C, however has a second bending line 50 and may extend outside this bending line in three different directions.

To the right side of FIG. 6 embodiments are shown in which the surfaces 42 which comprise the chords 1 of the profiles of the bottom side of the boat, are curved. These curved surfaces 42 have straight (preferably inclined) surface lines extending parallel to the vertical longitudinal center plane 38 of the boat hull. For simplification's sake, the curved surfaces 42 are shown without reference to the horizontal plane of the water level 3.

Figure 7:
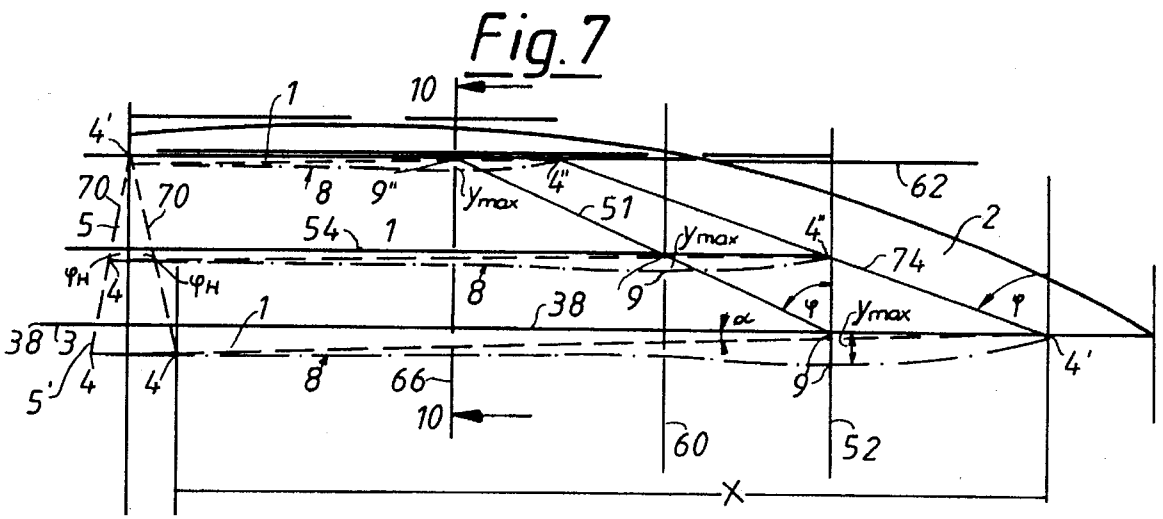
FIGS. 4 to 6 show different sectional views and FIGS. 7 and 8 show sweep possibilities for the boat hull.

FIG. 7 shows a bottom view of the boat hull 2 shown in FIG. 2, the carrying surfaces of which are sweeped to the rear. The vertical longitudinal center plane 38 of the boat hull coincides with the horizontal plane 3 and is drawn in FIG. 7 by a straight line, below of which there are drawn the respective longitudinal section of the profile 8 by dash-dotted-lines and the chord 1 extending angularly thereto by dashed lines. The apex point 9 is positioned in the vertical tranversal plane 52 in a distance $y_{max}$ from the chord 1.

In the longidutinal plane 54 extending in parallel to the longitudinal center plane 38, the bottom side of the boat hull disposed below the plane of the water level has a shorter longitudinal section of the profile 8 with a shorter chord 1 as the longitudinal section of the profile in the center plane 38; further, the apex point 9' has a smaller maximum value $y_{max}$ disposed in the transverse plane 60 which is disposed nearer to the stern as the transverse plane 52. The reason therefor is that the bow-side ends 4', 4" of the profile lines 8 or, respectively, of the chords 1 are disposed on a straight line (curve) inclined at an angle 90° —γv to the center plane 38 or, respectively, according to an alternative thereto in a plane (curved surface) 74, so that profiles disposed outwardly are reduced in size in a similar scale. In the vertical longitudinal plane 62 that extends parallel to the longitudinal plane 54 and to the longitudinal center plane 38, the bottom side of the boat hull 2 disposed below the waterlevel plane has a still shorter profile 8 with the apex point 9", the $y_{max}$ of it being smaller than that of the apex point 9'. The apex point 9" lies in a transverse plane 66 disposed nearer to the stern than the transverse plane 60. The three apex points 9,9',9", therefore, are disposed in a vertical plane (curved surface) 51 which includes the angle γ with the transverse plane 52. According to the invention, therefore, it is provided that, starting from the longitudinal section of the profile 8 in the center plane, towards the outside following longitudinal sections of the profile 8 or, respectively, chords I and/or the angle with the horizontal plane 3 of profile lines following towards the outside are shortened or, respectively, reduced in size considering the laws of similarity. Even if the angle of the chord 1 may decrease towards the outside, it does not reach the value 0°. An important value for the sweep of the profile or, respectively, for the similarity are the angles γ and $\gamma_v$, which are included by the surfaces 51 and 74 with the transverse planes to the longitudinal direction of the boat.

Above the horizontal plane of the waterlevel 3, the boat hull 2 at the stern has a backside 70 which may extend inclined at an angle $\gamma_H$ with respect to the vertical longitudinal center plane 38, as this is indicated by the two angles $\gamma_H$ in FIG. 7.

Whereas within the embodiment of FIG. 7 the surface 51 is a plane, there is also the possibility that it extends bent or, respectively, curved. This means that the ends 4',4" or, respectively, the apex points 9, 9', 9" have a bent or, respectively, a curved connection line. If the profile lines in the longitudinal planes (for example 38,54 62) have the same ratio of length to thickness, and if the length of their chords I is reduced with increasing distance from the longitudinal center plane 38, then the absolute values of the profile length or, respectively, of the chord length and of the apex thickness $y_{max}$, will decrease towards the side of the boat. Therefore, even if the chords 1 are disposed in the same horizontal plane, the bottom of the boat may rise towards the outside. This effect can be enhanced by the feature that the chords are disposed in the planes 42 according to FIGS. 4 and 6, instead of disposing them in the same height level.

Figure 8:
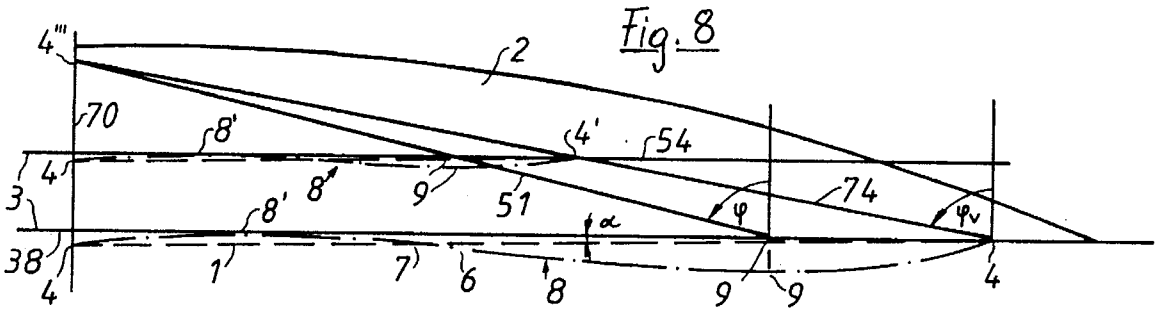

Within the shape of the boat hull 2 shown in FIG. 8, the length of the chords of the profile lines of the bottom side of the boat hull decrease from the inside towards the outside to zero in the point 4'". The front end points of the profiles are disposed on a vertical plane 74 which intersects the plane 51 (with the apex points) in the stern 70 in the point 4'". The more to the outside one of the vertical longitudinal section profiles is disposed, the smaller the distance from the front end point 4' of this profile from the apex points 9,9' will be, until they coincide in the point 4'".

According to the invention there is an angle of more than 1.3°. To above, there is a limit only by constructive reasons. Of advantage are angles of 1.7° to 3°. Angles of less than 1.3° have been shown as of less advantage. Very good results could be obtained with angles between 1.5° and 2.5°.

The inventive boat hulls are used with advantage for motor driven high speed planing crafts. The boat hulls may be used for vehicles comprising one or more hulls (catamarans).

In the following a general formula for the inventive curvature ($f_{(x)}$) of a profile longitudinal section is given:

$$f(x) = a_o + \sum_{k=1}^{n} a_k \cos k_x + \sum_{k=1}^{n} b_x \sin k_x$$

$$a_o = \frac{1}{2m} \sum_{q=o}^{q=2m-1} y_q$$

$$a_k = \frac{1}{2m} \sum_{q=o}^{q=2m-1} y_q \cos \frac{k_q \pi}{m}$$

$$b_k = \frac{1}{2m} \sum_{q=o}^{q=2m-1} y_q \sin \frac{k_q \pi}{m}$$

wherein m shall be an even number which indicates half the number of the supporting points. The coeffizients $a_k$ run from k=1 to m and the coeffizients $b_k$ from k=1 to m−1.

By supporting points the respective abscissa values along the boat are to be understood, the respective values of the ordinates are empirical found or are given and therefore define the course of the curve.

I claim:

1. A high speed planing craft having a hull comprising:

an underside forming a curved profile extending continuously from a bow end to a stern end;

a chord line extending linearly from the bow end to the stern end, the chord line defining a positive angle with the horizontal plane, the angle being less than 4 degrees and greater than 1.3 degrees when the boat hull is loaded and trimmed and when the boat is unloaded and trimmed; and a vertex point along the profile defined by the greatest vertical distance from the profile to the chord line, the vertex point being closer to the bow end than the stern end.

2. The high speed planing craft of claim 1 wherein the profile further includes a point of inflection between the vertex point and the stern end.

3. The high speed planing craft of claim 2 wherein the profile intersects the chord at an intersection point, the chord having a length, the point of inflection being a distance from the intersection point, the distance being less than 30 percent of the length of the chord.

4. The high speed planing craft of claim 1 wherein the profile further includes at least one intersection point with the chord line, the intersection point being closer to the stern end than the bow end.

5. The high speed planing craft of claim 4 wherein the profile only has one intersection point, the profile having a concave shape between the intersection point and the stern end.

6. The high speed planing craft of claim 1 further including a rectangular transom extending from the stern end of the profile to a top side of the hull, the transom having a lower edge coincident with the stern end, a substantial portion of the lower edge being below the water line when the boat is unloaded.

7. The high speed planing craft of claim 1 wherein the profile decreases in elevation from the stern end to the vertex point and increases in elevation from the vertex point to the bow end, the vertex point being at a first vertical distance from the chord and at a second distance from the bow end, the chord having a length, the first vertical distance being less than 30 percent of the length of the chord and the second distance being less than 40 percent and greater than 20 percent of the length of the chord.

8. The high speed planing craft of claim 1 further including first and second sides and a center longitudinal vertical plane equidistant between the first and second sides, the profile and the chord line being in the center longitudinal vertical plane, the boat hull further including a plurality of profiles and chord lines between the center longitudinal vertical plane and the first and second sides, each chord line defining a chord angle with respect to the horizontal plane.

9. The high speed planing craft of claim 1 further including first and second sides and a center longitudinal vertical plane equidistant between the first and second sides, the profile and the chord line being in the center longitudinal vertical plane, the boat hull further including a plurality of profiles and chord lines between the center longitudinal vertical plane and the first and second sides, the chord lines that are adjacent to the chord line in the center longitudinal vertical plane defining a chord angle with respect to the longitudinal plane.

10. The high speed planing craft of claim 1 further including first and second sides and a center longitudinal vertical plane equidistant between the first and second sides, the profile and the chord line being in the center longitudinal vertical plane of the hull, the boat hull further including a plurality of profiles and chord lines between the center longitudinal vertical plane and the first and second sides, each profile and respective chord line being positioned at a different elevation so to form a linear cross-sectional line that rises in elevation from the center longitudinal vertical plane to the first and second sides.

11. The high speed planing craft of claim 10 wherein each profile and respective chord line are coincident with each other at a bow end point and a vertex point, the bow end points being positioned so to form a line from the bow end of the profile in the center longitudinal vertical plane to the bow end points of the profiles at the first and second sides of the hull, the line being inclined at an acute angle with a vertical cross plane of the boat hull.

12. The high speed planing craft of claim 1 wherein the vertex point is at a distance from the bow end and the chord has a length, the distance being less than 40 percent and greater than 20 percent of the length of the chord.

13. The high speed planing craft of claim 1 wherein the vertex point is at a first vertical distance from the chord and the chord has a length, the first vertical distance being less than 25 percent of the length of the chord.

14. The of claim 13 wherein the profile extends above the chord, the profile including a top point defined by the greatest distance from the profile to the chord above the chord, the top point being a second vertical distance from the chord, the second vertical distance being less than 20 percent of the first vertical distance.

15. The high speed planing craft of claim 1 wherein the profile has a smooth surface shaped to create lift at the stern end of the hull when the boat hull moves along the water, the lift being created substantially from flow parallel to the longitudinal axis of the hull.

16. The high speed planing craft of claim 1 wherein the hull is free of planing steps.

* * * * *